US010966553B1

(12) United States Patent
Wilson-Brown

(10) Patent No.: US 10,966,553 B1
(45) Date of Patent: Apr. 6, 2021

(54) SYSTEM AND METHOD FOR A SHAWL BLANKET WITH FEET POCKETS FOLDABLE INTO A PILLOW

(71) Applicant: April R. Wilson-Brown, Owings Mills, MD (US)

(72) Inventor: April R. Wilson-Brown, Owings Mills, MD (US)

( * ) Notice: Subject to any disclaimer, the term of this patent is extended or adjusted under 35 U.S.C. 154(b) by 0 days.

(21) Appl. No.: 17/088,994

(22) Filed: Nov. 4, 2020

(51) Int. Cl.
*A47G 9/06* (2006.01)
*A47G 9/02* (2006.01)
*A47G 9/10* (2006.01)

(52) U.S. Cl.
CPC ..... *A47G 9/1045* (2013.01); *A47G 9/066* (2013.01); *A47G 9/0223* (2013.01)

(58) Field of Classification Search
CPC ..... A47G 9/02; A47G 9/0207; A47G 9/0223; A47G 9/0238; A47G 9/0253; A47G 9/06; A47G 9/066; A47G 9/10; A47G 9/1045; A47C 7/38; A47C 7/383
USPC .... 5/636, 639, 640, 482, 485, 490, 494, 495
See application file for complete search history.

(56) References Cited

U.S. PATENT DOCUMENTS 1,871,003 A * 8/1932 Longletz et al. .... A47C 27/002 5/490
2,045,784 A * 6/1936 Leve ..... A47G 9/062 5/419
2,344,010 A * 3/1944 Walsh ..... A41D 7/008 2/69
2,791,775 A * 5/1957 Sartell ..... A41D 15/04 2/69.5
3,381,306 A * 5/1968 Innes ..... A47G 9/086 2/69
5,454,125 A * 10/1995 Ratkowski ..... A47G 9/064 383/4
5,454,643 A * 10/1995 Sullivan ..... A45C 3/10 383/127
5,457,829 A * 10/1995 Elliott ..... A47G 9/0207 5/420
5,481,768 A * 1/1996 Shink ..... A47G 9/02 297/397
5,533,653 A * 7/1996 Kaufman ..... A45C 3/10 224/577
5,618,110 A * 4/1997 Sullivan ..... A45C 3/10 224/153
5,688,052 A * 11/1997 Compton ..... A45C 3/10 383/38
5,850,643 A * 12/1998 Brumfield ..... A47G 9/062 5/419
5,920,931 A * 7/1999 Zuehlke ..... A47G 9/1045 5/419
5,970,542 A * 10/1999 Mays ..... A47G 9/066 2/69.5
5,987,667 A * 11/1999 Haverly ..... A47G 9/1045 5/417
6,023,797 A * 2/2000 Brumfield ..... A47G 9/1045 383/4

(Continued)

*Primary Examiner* — Robert G Santos
(74) *Attorney, Agent, or Firm* — Christopher Mayle; Thomas E. LaGrandeur; Bold IP, PLLC

(57) ABSTRACT

A system and method for a blanket that is convertible into a pillow by a series of folds where the body of the blanket is eventually positioned inside of a pocket positioned at the ends of the top side and bottom side of the blanket such that the pillow remains intact until the user removes the remainder of the blanket from the pocket and unfolds the blanket.

13 Claims, 12 Drawing Sheets

(56) References Cited

U.S. PATENT DOCUMENTS 6,243,873 B1 * 6/2001 Aliff ..... A41D 3/08 2/84
6,367,083 B1 * 4/2002 November ..... A47G 9/064 2/69.5
6,393,638 B1 * 5/2002 MacColl ..... A45F 4/02 383/4
6,408,462 B1 * 6/2002 Moore ..... A41D 3/08 2/69
6,634,041 B2 * 10/2003 Higashi ..... A45C 3/10 383/4
6,643,870 B2 * 11/2003 Bertrand ..... A47G 9/066 2/69
6,647,570 B1 * 11/2003 Ong ..... A47G 9/02 5/417
6,952,845 B1 * 10/2005 Akkad ..... A45F 4/02 383/4
7,058,997 B1 * 6/2006 Klinger ..... A45F 4/08 190/18 A
7,111,343 B1 * 9/2006 Bates ..... A45C 9/00 383/4
7,516,500 B2 * 4/2009 Akkad ..... A45F 4/02 383/4
D630,820 S * 1/2011 Wilson ..... D2/826
8,464,374 B1 * 6/2013 Thayer ..... A47G 9/064 5/482
10,231,560 B2 * 3/2019 Carlile ..... A47G 9/0223
10,722,056 B2 * 7/2020 Thomas ..... A47G 9/064
2001/0032360 A1 * 10/2001 Bertrand ..... A47G 9/066 5/482
2002/0129445 A1 * 9/2002 Deering ..... A47G 9/066 5/482
2003/0061659 A1 * 4/2003 Dunlap ..... A47G 9/066 5/485
2003/0135925 A1 * 7/2003 Higashi ..... A45C 3/10 5/417
2004/0040088 A1 * 3/2004 Lowell ..... A47G 9/066 5/417
2005/0071920 A1 * 4/2005 Higashi ..... H01R 13/523 5/417
2005/0262634 A1 * 12/2005 Gottlieb ..... A47G 9/1045 5/482
2005/0283910 A1 * 12/2005 DuQue ..... A47G 9/1045 5/482
2006/0037139 A1 * 2/2006 Akkad ..... A45F 4/02 5/419
2006/0200906 A1 * 9/2006 Deering ..... A47G 9/1045 5/482
2008/0083066 A1 * 4/2008 Linn ..... A47G 9/062 5/485
2013/0189898 A1 * 7/2013 Abbott ..... A47G 9/0207 446/73
2018/0064269 A1 * 3/2018 Carlile ..... A47G 9/066
2019/0208936 A1 * 7/2019 Thomas ..... A47G 9/066
2020/0077819 A1 * 3/2020 Thibodeau ..... A41D 15/04

* cited by examiner

SYSTEM AND METHOD FOR A SHAWL BLANKET WITH FEET POCKETS FOLDABLE INTO A PILLOW

FIELD OF DISCLOSURE

The overall field of this invention relates generally to a shawl blanket and more specifically to a shawl blanket with multiple pockets, such that the blanket may be folded up and tucked into one of the pockets to be used as a pillow or seat cushion when needed.

BACKGROUND

There have been a number of different blankets designed to keep a person warm and protected from drafts and other cold conditions There have also been a number of pillows designed to provide comfort and support for a user's head. It would be advantageous to have a device that operates as pillow and a blanket while traveling for car rides, daycare, home, and stadium games, and also while at home, to provide comfort and warmth. Existing combination pillow and blankets are not very comfortable for the user or are overly complicated to use. Thus, there still exists the need for a combination pillow and blanket that will keep the user warm and is also able to fold up into a pillow as needed.

SUMMARY

The present invention is directed to a system for a convertible blanket and pillow including a blanket having a top planar surface and a bottom planar surface, the blanket having a u shape with an upper body, the blanket having a first prong and a second prong extending downward from the upper body, the first prong having a first end and the second prong having a second end, the second end symmetrical to the first end along a vertical axis wherein the blanket is configured to be grasped by a user's neck and wrap and their shoulders as a shawl, a first pocket secured to the top planar surface of the blanket at the first end; the pocket having a top face and four side edges, the first pocket secured to the blanket along three of the side edges, the fourth side edge not securing forming an opening between the top surface and the pocket, the opening facing upwards in the direction of the upper body, a second pocket having the same construction as the first pocket, the second pocket secured to the top planar surface of the blanket in the same configuration as the first pocket, the second pocket positioned at the second end of the blanket, the pockets configured to receive a user's feet and for an area of the blanket to be inserted into the pockets, wherein to switch from a blanket configuration to a pillow configuration, the blanket is folded up in half wherein the first prong is folded on top of the second prong creating a first fold, a first length of the blanket a distance from a top of the upper body is then taken and folded over top of the blanket a plurality of times to create a folded portion, each fold shortening the size of the blanket, wherein then after the plurality of folds are created, a second length including the first pocket is positioned over the folded portion, the folded portion and the second length including the first pocket is then taken and inserted into the second pocket, wherein when the blanket has been folded once a second fold is folded to a bend formed by the upper body and the first prong and the second prong, wherein the plurality of folds is three.

The present invention is also directed to a system for a convertible blanket and pillow including a blanket having a top planar surface and a bottom planar surface, the blanket having a u shape with an upper body, the blanket having a first prong and a second prong extending downward from the upper body, the first prong having a first end and the second prong having a second end, the second end symmetrical to the first end along a vertical axis wherein the blanket is configured to be grasped by a user's neck and wrap and their shoulders as a shawl, a first pocket secured to the top planar surface of the blanket at the first end, an opening of the pocket facing upwards in the direction of the upper body, a second pocket secured to the top planar surface of the blanket at the second end, an opening of the pocket facing upwards in the direction of the upper body, wherein to switch from a blanket configuration to a pillow configuration, the blanket is folded up in half along the vertical axis, a first length of the blanket a distance from a top of the upper body is then taken and folded over top of the blanket a plurality of times to create a folded portion, wherein then after the plurality of folds are created, a second length including the first pocket is positioned over the folded portion, the folded portion and the second length is then taken and inserted into the second pocket, wherein when the blanket has been folded along the vertical axis, a second fold is folded to a bend formed by the upper body and the first prong and the second prong.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
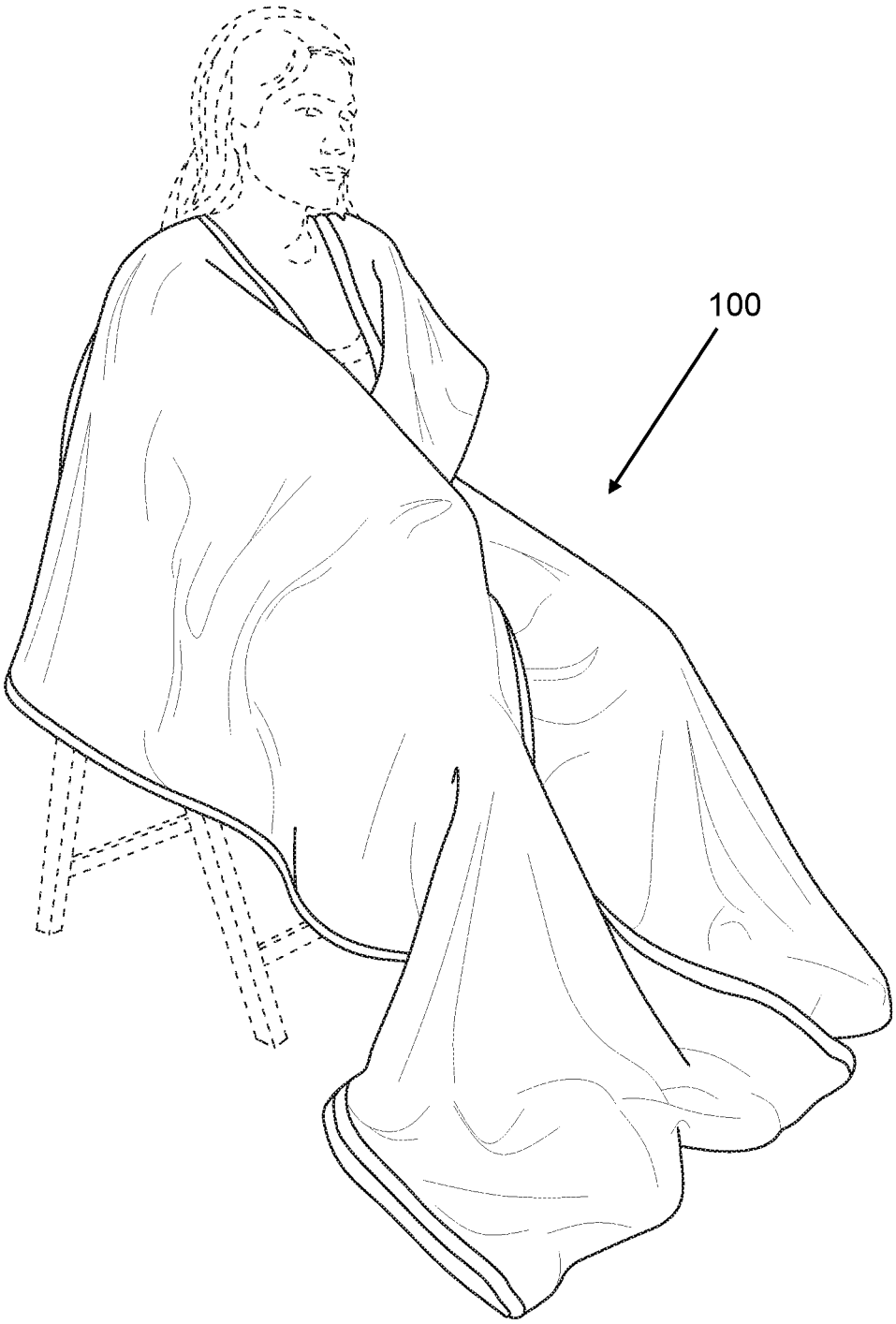
FIG. 1 is an illustration of the shawl blanket on a user whereby the blanket is convertible into a pillow configuration.

In the Summary above and in this Detailed Description, and the claims below, and in the accompanying drawings, reference is made to particular features (including method steps) of the invention. The term "comprises", and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure recognizes the unsolved need for a system and method for a blanket that may be converted into a pillow by a series of folds where the body of the blanket is eventually positioned inside of a pocket positioned at the ends of the top side and bottom side of the blanket, such that the pillow remains intact until the user removes the remainder of the blanket from the pocket and unfolds the blanket.

Figure 2:
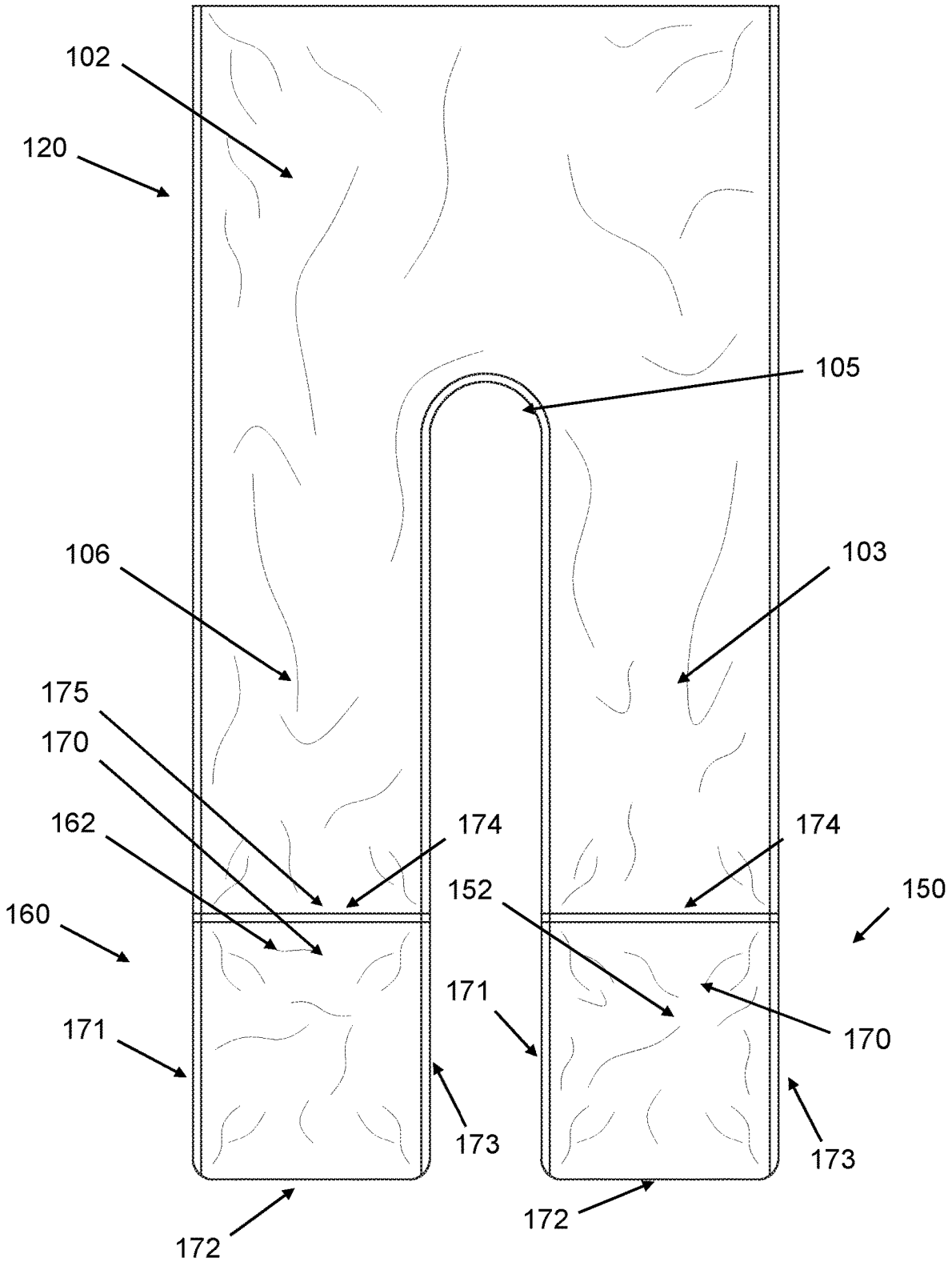
FIG. 2 is an illustration of the bottom surface of the shawl blanket.
Figure 3:
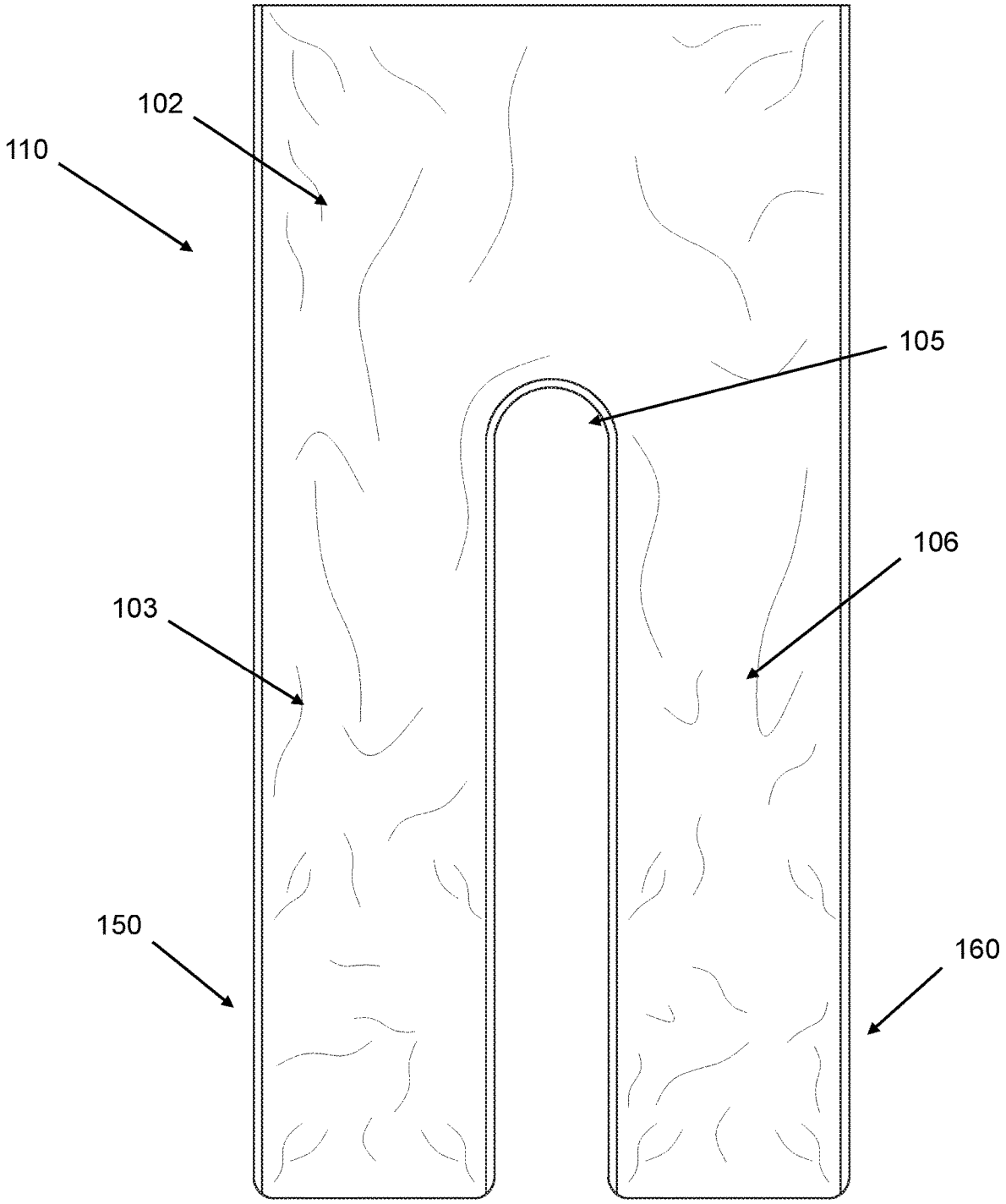
FIG. 3 is an illustration of the top surface of the shawl blanket.

With reference now to FIG. 1, one embodiment of a convertible shawl blanket and pillow 100 according to the present invention is illustrated. FIG. 1 illustrates a front perspective view of a shawl blanket 100 which takes the form of a shawl that is worn around the user's neck, while FIG. 2 shows a bottom view and FIG. 3 shows a top view of the shawl blanket 100 according to one or more non-limiting embodiments. Shawl blanket 100 is a blanket but in the form of a shawl because it may be worn around the user's neck if so desired by placing bend 105 over the back and sides of the user's neck as shown in FIG. 1 and FIG. 2. A user may also lay shawl blanket 100 over his or her legs or knees or any other way and is not required to wear shawl blanket 100 over his or her neck. When worn as a shawl, the shawl blanket 100 may be wrapped around one's shoulders and worn around the user's neck if so desired. Advantageously, shawl blanket 100 may offer multiple advantages in its use because it may be worn as a shawl, a blanket, and also used as a pillow as further explained below.

Figure 4:
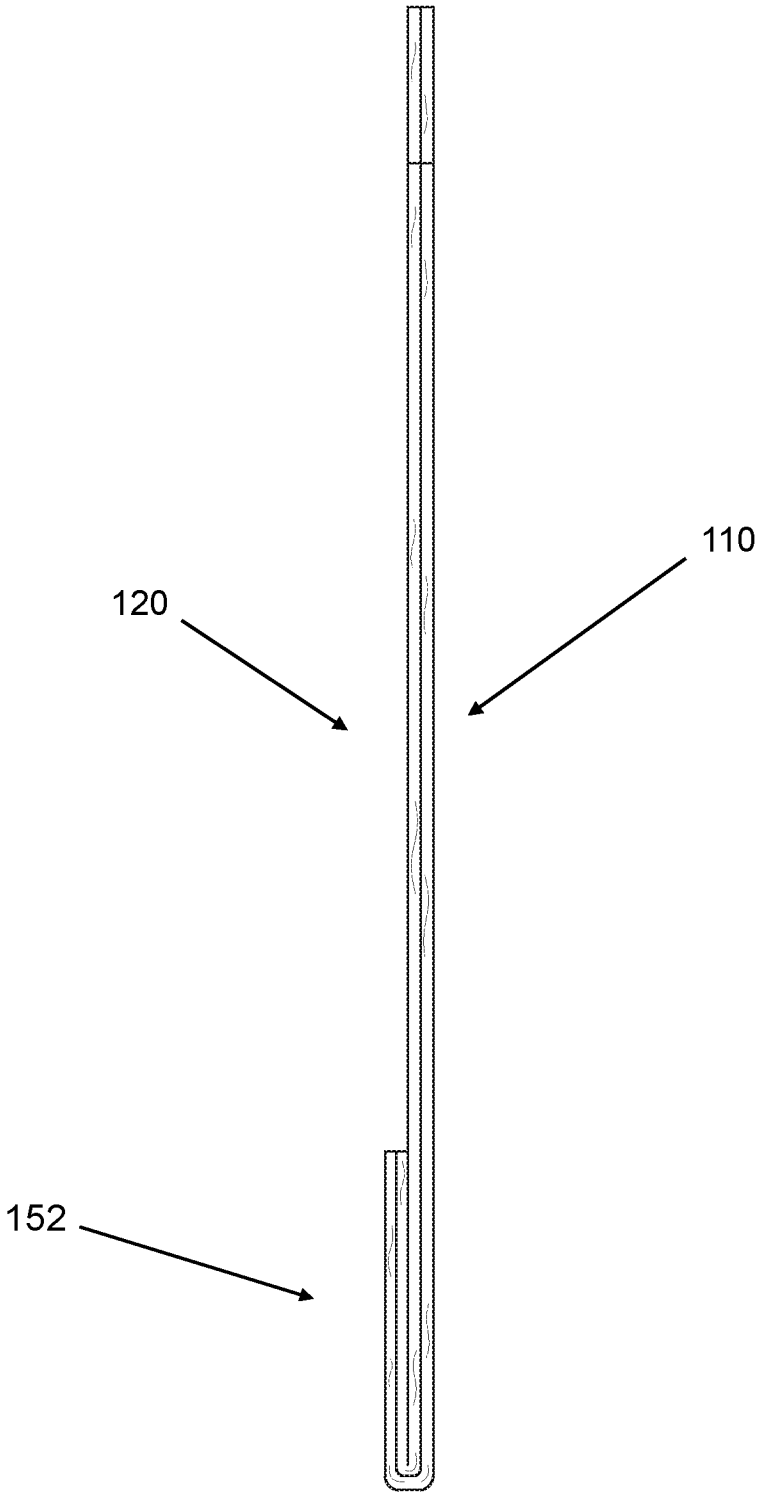
FIG. 4 is a side view of the shawl blanket.

As shown in FIGS. 1-4, shawl blanket 100 may have planar top surface 110 as shown in FIG. 3 and a bottom planar surface 120, as shown in FIG. 2. Bottom planar surface 120 may have the same configuration as top surface 110. In a non-limiting embodiment, side surfaces interconnecting top surface and bottom surface 120. As illustrated in FIG. 2, FIG. 3, and FIG. 4, shawl blanket 100 may be generally elongated with a "U" shape having three areas including an upper body 102, a first prong 103, and a second prong 106 extending downward from upper body 102 whereby a bend 105 is formed as shown in FIG. 2. In other words, first prong 103 and second prong 106 may be the side portions that hang down from either side of bend 105 and from upper body 102. First prong may have a first end portion 150 positioned at opposing longitudinal ends of shawl blanket 100 from the upper body 102. Second prong 106 may have a second end portion 160 positioned at opposing longitudinal ends of shawl blanket 100 from upper body 102 and symmetrical to first end portion 150 along the vertical axis. The "U" shape design allows shawl blanket 100 to be positioned around a user's neck, such that shawl blanket 100 can be placed around the user's shoulders at bend 105, as shown in FIG. 2, with bend 105 contacting the back of a user's neck when the shawl blanket 100 is worn in the blanket configuration whereby bottom surface 120 is worn on user's neck with top surface 110 facing upwards.

Shawl blanket 100 may be made of one layer or may include multiple layers. In one embodiment, shawl blanket 100 is made from fabric. The fabric material suitable for making shawl blanket 100 may be vary. In one embodiment, the fabric used may be cotton, which may be suitable for warmer weather, and in other embodiments, the fabric may include wool so as to provide more warmth in colder environments. The fabric may be natural, man-made, synthetic, or blended. Shawl blanket 100 may be solid with no patterns in some embodiments and may include patterns and/or one or more designs in other embodiments. Further, shawl blanket 100 may include logos or images tailored to specific interests of a user. Shawl blanket 100 is also conventionally washable and dryable whereby such washing and drying alters none of the provided properties thereof.

Figure 11:
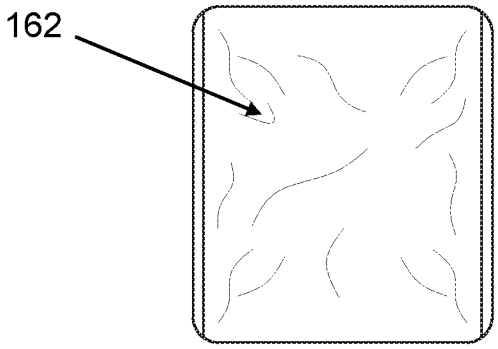
FIG. 11 is an illustration of the shawl blanket converted into a pillow.
Figure 12:
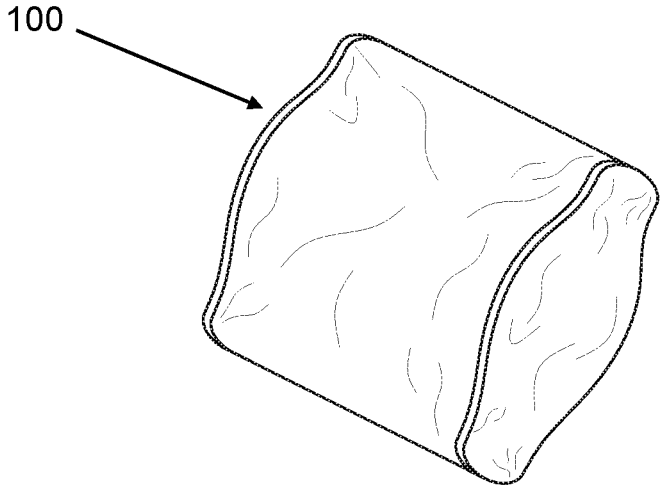
FIG. 12 is another illustration of the pillow of FIG. 11.

FIG. 2 provides a bottom view of the application of shawl blanket 100. As shown in FIG. 2, shawl blanket 100 may have two pockets 152 and 162 that have multiple purposes. In one embodiment, pockets 152 and 162 are configured for a user to place his or her feet in pockets 152 and 162 when shawl blanket 100 is extended in the blanket configuration. Further, pockets 152 and 162 also can receive or contain the a remainder of shawl blanket 100 when shawl blanket 100 is folded into the pillow configuration as shown in FIGS. 11-12. As shown in FIG. 2, at first end portion 150 of first prong 103, pocket 152 is formed around the end or near the end of bottom surface 120 in a manner that is meant to partially secure shawl blanket 100 within itself when folded in a first configuration to switch from a blanket configuration into a pillow configuration. By the term "partially secure", it is meant herein that that such securement is at least partially fixed and resists removal thereof and that a remainder of shawl blanket 100 may be stored within pocket 152 until a user is ready to remove the remainder of shawl blanket 100 from pocket 152 when intended.

As shown at a second end portion 160 of second prong 106, pocket 162 is formed around the end or near the end top surface 110 in a manner that is meant to partially secure shawl blanket 100 within itself when folded in a third orientation to switch from a blanket configuration into a pillow configuration.

Pockets 152 and 162 may each have a top planar surface 170 and side edges 171, 172, 173, and 174. Side edges 171, 172, and 173 of pocket 152 and 162 may be secured by stitching or otherwise attaching the side edges 171, 172, 173 of pockets 152 and 162 to the top surface 110 at first end portion 150 and second end portion 160 with the top side edge 174 of pockets 152 and 162 left unsecured. Thus pockets 152 and 162 include an opening 175 facing upwards in the direction of the upper body 102.

Pockets 152 and 162 may be structurally formed in multiple ways. In one embodiment, pockets 152 and 162 are formed from the same material as shawl blanket 100. In one embodiment, pockets 152 and 162 are formed as folded over portions of shawl blanket 100. In another embodiment, pockets 152 and 162 may be separate components that are fastened to end portions 150 and 160. Pockets 152 and 162 may be made by stitching end portions of 150 and 160 of shawl blanket 100 as known by persons of skill in the art. When stretched, the stitches do not pull into shawl blanket's 100 material. One or more stability pieces may also be fitted in between pockets 152 and 162 and end portions 150 and 160 such that connection is further strengthened. In further embodiments, additional stitches may be sewn or otherwise fastened a few inches from the previous stitching to create a secondary pocket to hold various useful items in the shawl blanket 100 (e.g. phones, keys, lotion, remotes, etc.)

Figure 5:
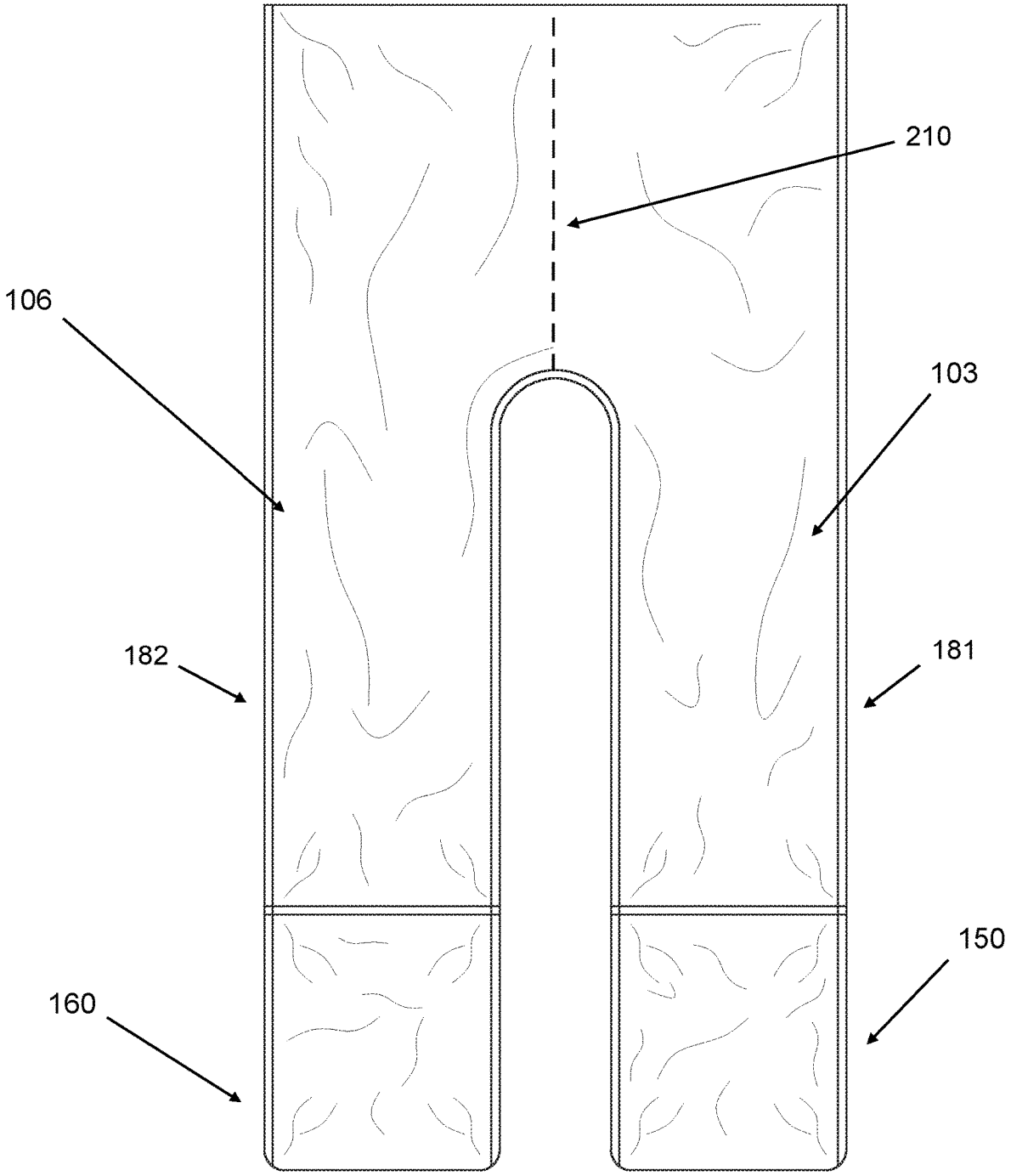
FIG. 5 illustrates the first step in an exemplary process of converting the shawl blanket into a pillow.
Figure 6:
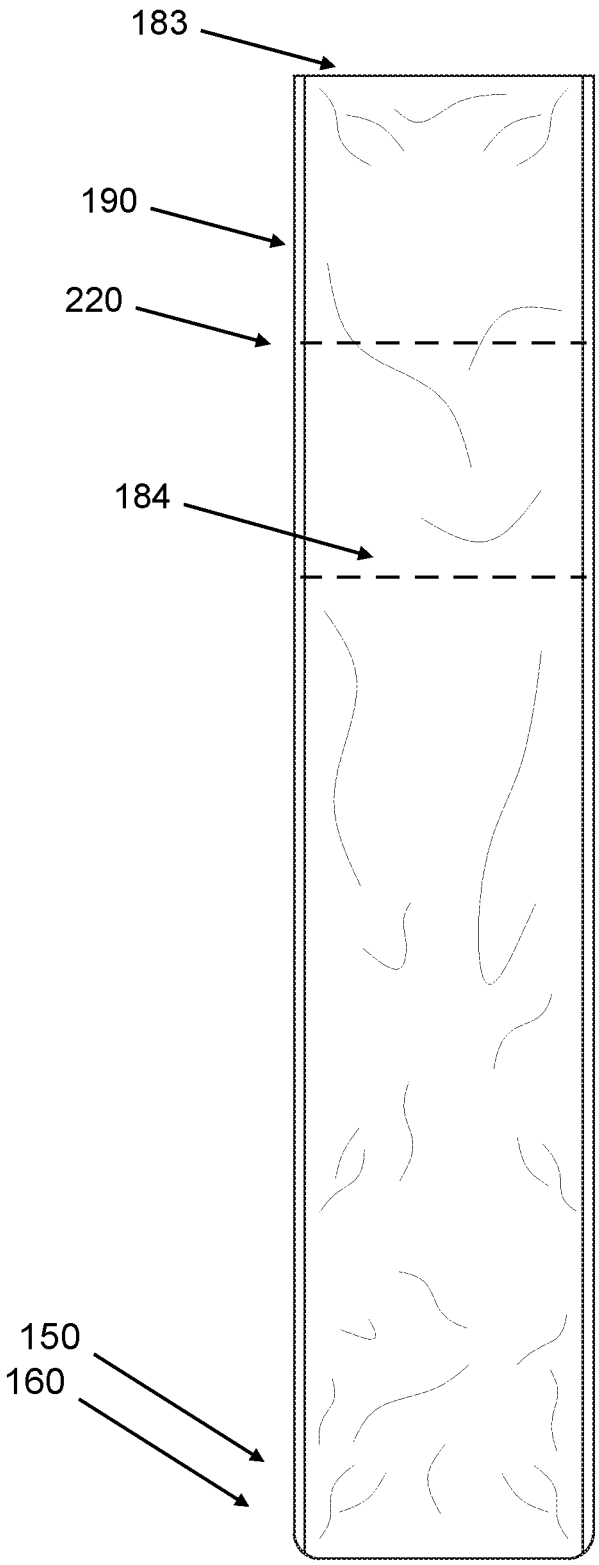
FIG. 6 illustrates the second step in an exemplary process of converting the shawl blanket into a pillow.

As discussed, the conversion from the blanket configuration to the pillow configuration for shawl blanket 100 may be accomplished by a series of folds. As illustrated in FIG. 5, shawl blanket 100 may be laid on a surface with bottom planar surface 120 facing upwards. Depicted in FIG. 5 is the first fold formed to convert blanket configuration into a pillow configuration. First fold 210 is located substantially half way between outer edge 181 of first prong 103 and outer edge 182 of second prong 106, along which oppositely disposed edges 181 and 182 are folded toward each other. When folded, edges 181 and 182 are parallel with each other with edge 181 positioned above edge 182. In this orientation, pockets 152 and 162 are parallel with each other with pocket 152 located above and facing down towards pocket 162. FIG. 6 shows the configuration of the shawl blanket 100 upon completion of the first fold 210.

Figure 7:
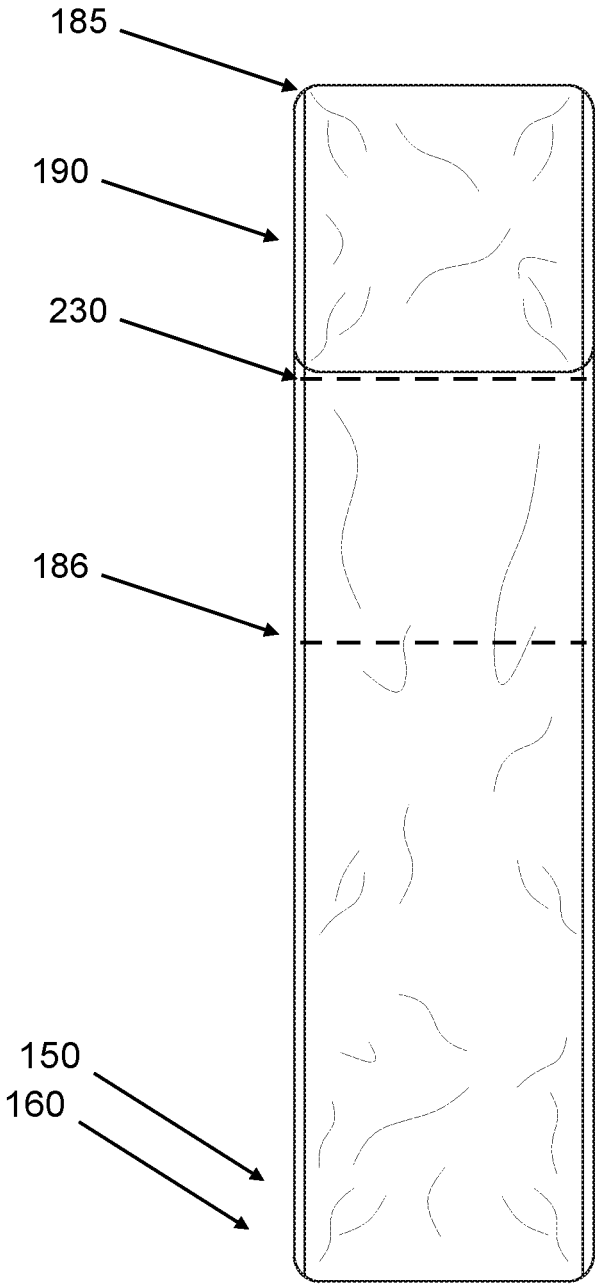
FIG. 7 illustrates the third step in an exemplary process of converting the shawl blanket into a pillow.

As illustrated in FIG. 6, a second fold 220 may be located substantially at the border of middle portion and end portion of upper body 102 between the previous first fold 210 and end portions 150 and 160, in which first fold 210 is taken and folded toward end portions 150 and 160 such that a top portion 190 of the shawl blanket 100 is folded at the second fold 220 over a remainder of shawl blanket 100, whereby when folded, the top portion 190 reaches the upper point of bend 105. The top portion 220 may be folded in a longitudinal direction over the second fold 220. In this folding process, edges 183 and 184 are folded toward each other such that edges 183 and 184 are now parallel with each other with edge 183 lying above edge. FIG. 7 shows the configuration of the shawl blanket 100 upon completion of the second fold 220.

Figure 8:
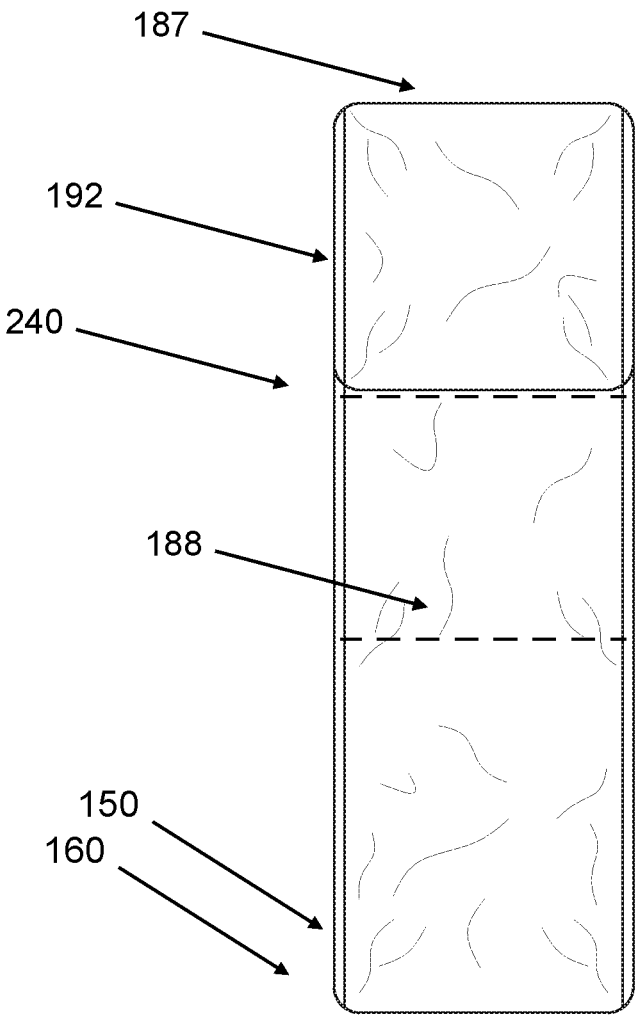
FIG. 8 illustrates the fourth step in an exemplary process of converting the shawl blanket into a pillow.

As illustrated in FIG. 7, a third fold 230 may be formed by taking top portion 190 and folding top portion 190 toward end portions 150 and 160 such that a newly formed folded portion 192 (e.g. as shown in FIG. 8) of shawl blanket 100 is folded over the remainder of shawl blanket 100. In this folding process, edges 185 and 186 are folded toward each other such that edges 185 and 186 are now parallel with each other with edge 185 lying above edge 186. Edge s 183 and 184 are the same or substantially the same length as edges 185 and 186. FIG. 8 shows the configuration of the shawl blanket 100 upon completion of the third fold 230. The series of folds takes place along the longitudinal direction of shawl blanket 100 in one or more non-limiting embodiments as shown in FIGS. 1-12.

Figure 9:
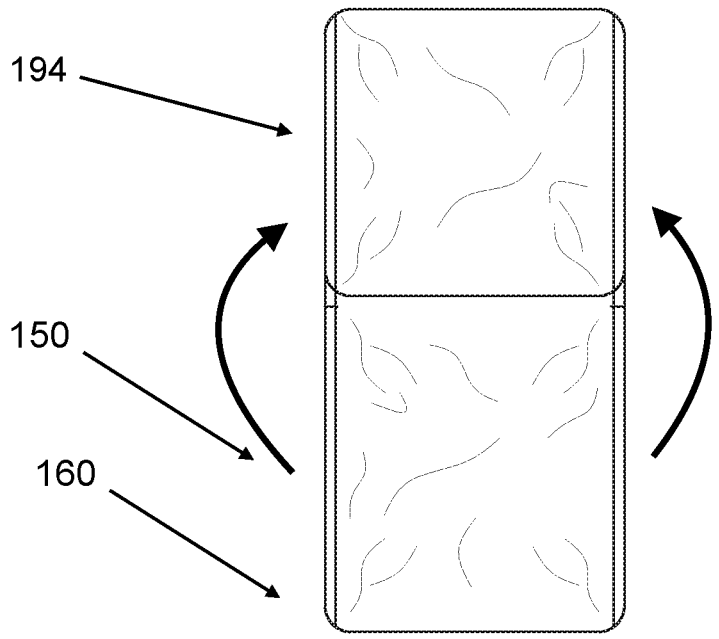
FIG. 9 illustrates the fifth step in an exemplary process of converting the shawl blanket into a pillow.

As illustrated in FIG. 8, a fourth fold 240 may be formed by taking folded portion 192 and folding folded portion 192 toward end portions 150 and 160 such that a formed folded over portion 194, as shown in FIG. 9, of shawl blanket 100 blanket is folded over the remainder of shawl blanket 100. In this folding process edges 187 and 188 are folded toward each other such that edges 187 and 188 are now parallel with each other with edge 187 lying above edge 188. Edges 187 and 188 are the same or substantially the same length as edges 183 and 184, and 185 and 186. FIG. 9 shows the configuration of the shawl blanket 100 upon completion of the fourth fold 240.

Figure 10:
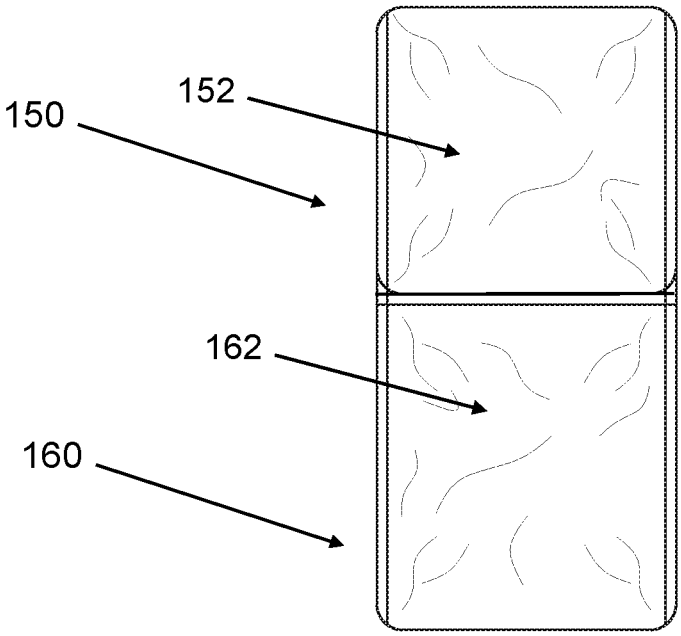
FIG. 10 illustrates the sixth step in an exemplary process of converting the shawl blanket into a pillow.

As shown in FIG. 9, to completely convert the blanket configuration into the pillow configuration, first end portion 150 is folded back over edge 194 (e.g. following the arrows shown in FIG. 9) such that pocket 152 and top surface 110 are facing upwards and positioned above the remaining portion of shawl blanket 100. FIG. 10 shows that, in the final stages of folding the blanket 100 into the pillow configuration, pocket 152 and pocket 162 are positioned such that pocket 152 is above pocket 162. The entirety of shawl blanket 100 as contained in pocket 152 is then taken and placed within pocket 162 as illustrated in FIG. 11 and FIG. 12 to form the pillow configuration. It should be understood similar methods of folding may be used to position blanket configuration into pocket 152 depending on the initial orientation and folding of shawl blanket 100. In some embodiments, there may be only one pocket, or four pockets with pockets positioned on the bottom surface 120 parallel with pockets 152 and 162 whereby a similar process may be used to position blanket configuration into the pockets.

A number of advantages are provided by the shawl blanket 100 described above in one or more non-limiting embodiments. The shawl blanket 100 may be worn as a shawl when needed and may easily be converted into a pillow via series of folds. Further, the shawl blanket 100 may include pockets, such as pockets 152 and 162 which the wearer may place their feet in to warm their feet when the shawl blanket 100 is fully open in its shawl configuration. Further, pockets 152 and 162 function to contain portions of the fabric material of shawl configuration 100 in order to form the pillow configuration. As noted above, the shawl blanket 100 may be better than other similar products because shawl blanket 10 is easier to fold into a pillow and to unfold. Further, the inclusion of pockets 152 and 162 help to keep the material secure in the pillow configuration. Additional secondary pockets may be included and sewn or otherwise formed in shawl blanket 100 that can be used to temporarily store useful items such as, but not limited to, phones, keys, lotion, remotes, etc.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated. The scope of the invention is to be defined by the below claims.

What is claimed is:

1. A shawl blanket taking the form of a shawl that is configured to be worn around a user's neck, the shawl blanket foldable into a pillow, the shawl blanket comprising:

a top planar surface and a bottom planar surface, the shawl blanket comprising an upper body portion, the shawl blanket having a "U" shape with a bend such that the shawl blanket is wearable around the user's neck, the shawl blanket further comprising a first prong and a second prong extending downward from the upper body portion, the first prong having a first end and the second prong having a second end, wherein the second end is symmetrical to the first end along a vertical axis;

a first pocket and a second pocket, the first pocket and the second pocket each having four side edges, wherein the first pocket is formed on the first prong and the second pocket is formed on the second prong, wherein the first pocket and the second pocket each include a pocket opening and are secured to the first prong and the second prong respectively along three of the four side edges;

a first fold located half way between an outer edge of the first prong and an outer edge of the second prong, along which the outer edge of the first prong and the outer edge of the second prong are folded toward each other at the first fold;

a second fold located between an end portion of the upper body portion and the first end, in which the end portion of the upper body portion is taken and folded toward the first end at the second fold;

a third fold located between the second fold and the first end, in which a folded portion of the shawl blanket is taken and folded toward the first end at the third fold; and a fourth fold located between the third fold and the first end, in which a second folded portion of the shawl blanket is taken and folded toward the first end and the second end at the fourth fold.

2. The shawl blanket of claim 1, wherein the first pocket and the second pocket comprise folded over portions of the shawl blanket.

3. The shawl blanket of claim 1, wherein the first pocket and the second pocket are formed as separate components stitched into the shawl blanket.

4. The shawl blanket of claim 1, wherein when the shawl blanket has been folded fully, a pillow is formed.

5. The shawl blanket of claim 1, further comprising a fifth fold located between the fourth fold and the first end, in which the first end is taken and folded toward the fourth fold at the fifth fold.

6. A shawl blanket taking the form of a shawl that is configured to be worn around a user's neck, the shawl blanket foldable into a pillow, the shawl blanket comprising:

a top planar surface and a bottom planar surface, the shawl blanket having a "u" shape with an upper body portion, the shawl blanket having a first prong and a second prong extending downward from the upper body portion, the first prong having a first end and the second prong having a second end, the second end symmetrical to the first end along a vertical axis;

a first pocket secured to the top planar surface of the shawl blanket at the first end, the first pocket comprising a pocket opening facing upwards in the direction of the upper body portion;

a second pocket secured to the top planar surface of the shawl blanket at the second end, the second pocket having a pocket opening, wherein in the folded configuration, an entirety of the shawl blanket is first folded in half at a first fold and a portion of the shawl blanket inserted into either the first pocket or the second pocket in order to form the pillow;

a second fold positioned between an end portion of the upper body portion and the first end, in which the end portion of the upper body portion is taken and folded toward the first end at the second fold;

a third fold positioned between the second fold and the first end, in which a folded portion of the shawl blanket is taken and folded toward the first end at the third fold; and a fourth fold positioned between the third fold and the first end, in which a second folded portion of the shawl blanket is taken and folded toward the first end and the second end at the fourth fold.

7. The shawl blanket of claim 6, wherein the first pocket and the second pocket are formed from folded over portions of the shawl blanket.

8. The shawl blanket of claim 6, wherein the first pocket and second pocket are stitched into the blanket.

9. The shawl blanket of claim 6, further comprising a fifth fold positioned between the fourth fold and the first end.

10. A shawl blanket, that is configured to be worn around a user's neck and is foldable into a pillow, the shawl blanket comprising:

a top planar surface and a bottom planar surface; an upper body portion; a first prong and a second prong extending downward from the upper body portion, the first prong having a first end and the second prong having a second end;

a first pocket secured to the top planar surface of the shawl blanket; and a second pocket secured to the top planar surface of the shawl blanket, wherein the shawl blanket is switchable from a blanket configuration to a pillow configuration;

a first fold half way between an outer edge of the first prong and an outer edge of the second prong, the first fold formed by the outer edge of the first prong and the outer edge of the second prong folded toward each other;

a second fold located between an end portion of the upper body portion and the first end, the second fold formed by the upper body portion being taken and folded toward the first end;

a third fold located between the second fold and the first end, the third fold formed by a folded portion of the shawl blanket being taken and folded toward the first end; and a fourth fold located between the third fold and the first end, the fourth fold formed by a second folded portion of the shawl blanket being taken and folded toward the first end.

11. The shawl blanket of claim 10, further comprising a fifth fold located between the fourth fold and the first end, the fifth fold formed by the first end being taken and folded toward the fourth fold.

12. The shawl blanket of claim 10, wherein the first pocket and the second pocket are formed from one or more folded portions of the shawl blanket.

13. The shawl blanket of claim 10, wherein the first pocket and the second pocket are stitched into the shawl blanket.

* * * * *